US006253584B1

(12) United States Patent
Shin

(10) Patent No.: US 6,253,584 B1
(45) Date of Patent: Jul. 3, 2001

(54) WASHING MACHINE HAVING A DEVICE FOR FILTERING DIRT IN WASHING WATER

(75) Inventor: Jeong Soo Shin, Suwon (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/423,215

(22) PCT Filed: Jan. 18, 1999

(86) PCT No.: PCT/KR99/00029

§ 371 Date: Nov. 4, 1999

§ 102(e) Date: Nov. 4, 1999

(87) PCT Pub. No.: WO99/45187

PCT Pub. Date: Sep. 10, 1999

(30) Foreign Application Priority Data

Mar. 5, 1998 (KR) ..... 98/7265
May 13, 1998 (KR) ..... 98/17180

(51) Int. Cl.[7] ..... D06F 39/10
(52) U.S. Cl. ..... 68/13 R; 68/18 F
(58) Field of Search ..... 68/13 R, 18 R, 68/18 F, 18 D

(56) References Cited

U.S. PATENT DOCUMENTS 3,194,628 * 7/1965 Cannon ..... 68/13 R X
3,313,311 * 4/1967 Gilson ..... 68/18 F X

FOREIGN PATENT DOCUMENTS 43 42 049 A1 6/1995 (DE) .
0 146 719 7/1985 (EP) .
0585519 * 3/1994 (EP) ..... 68/18 F

* cited by examiner

*Primary Examiner*—Philip R. Coe
(74) *Attorney, Agent, or Firm*—Larson & Taylor, PLC

(57) ABSTRACT

Disclosed is a washing machine having a device (30) for filtering dirt in washing water. The device has a drawing pipe (31) connected to a tub (21) for accommodating laundry and water, a pump (33) for drawing the water in the tub into the drawing pipe, a cylinder (35) for receiving the water supplied from the drawing pipe, a rotating blade for generating a water-flow vortex in the cylinder, and a return pipe (37) for returning the water in which dirt has been filtered into the tub. The device can filter the dirt in the water effectively, and need not be cleaned frequently.

10 Claims, 6 Drawing Sheets

WASHING MACHINE HAVING A DEVICE FOR FILTERING DIRT IN WASHING WATER

TECHNICAL FIELD

The present invention relates to a washing machine, and more particularly, to a washing machine having a device for filtering dirt in washing water.

BACKGROUND ART

FIG. 6 is a side sectional view of a conventional washing machine. The washing machine has an outer casing 101, a top cover 105 covering the upper side of the outer casing 101, an outer tub 111 suspended by a suspension in the outer casing 101, a washing tub 113 rotatably installed in the outer tub 111, a pulsator 115 installed on the bottom of the washing tub 113, and a driving motor 118 for driving the pulsator 115.

During the washing operation, the driving motor 118 rotates the pulsator 115, and by the water-flow vortex generated in such a situation, the laundry in the washing tub 113 is washed. During the dehydrating operation, the pulsator 115 and the washing tub 113 are rotated together at a high speed, and the laundry is dehydrated by the centrifugal force generated in that situation.

During the washing operation, the water in the washing tub 113 contains dirt detached from the laundry, and if the washing water contains too much dirt, the washing effect is lowered. Thus, the washing machine is equipped with a device for filtering dirt in the washing water.

The filtering device is comprised of a circulation duct 125 formed vertically on the inner wall of the washing tub 113, and a filtering web 127 installed on the upper end of the circulation duct 125. The lower end of the circulation duct 125 is open at the lower area of the washing tub 113, and the upper end thereof is open at the upper area of the washing tub 113.

By the centrifugal force of the water-flow vortex generated in the washing tub 113, the washing water in the washing tub 113 flows into the circulation duct 125 through the lower opening of the circulation duct 125. The water in the circulation duct 125 is moved up along the circulation duct 125, and then is supplied again into the washing tub 113. In this situation, the dirt contained in the re-supplied washing water is filtered by the filtering web 127, and accordingly, the washing water in which dirt has been filtered is supplied into the washing tub 113.

However, in such a conventional washing machine, the filtering efficiency is lowered gradually as the dirt is accumulated in the filtering web 127, so the filtering web 127 must be cleaned frequently. And, the filtering web 127 is apt to wear, so it should be exchanged with a new one frequently. Furthermore, there is another shortcoming that the small and weighty dirt such as sand cannot be filtered well.

DISCLOSURE OF INVENTION

The present invention has been proposed to overcome the above-described problems in the prior art, and accordingly it is the object of the present invention to provide a washing machine having a filtering device which can filter the dirt in the washing tub effectively, does not need a frequent cleaning, and can be used semi-permanently.

To achieve the above object, the present invention provides a washing machine comprising: a tub for accommodating laundry and water; a drawing pipe connected to the tub; a drawing pump installed on an area of the drawing pipe, the drawing pump for drawing the water in the tub into the drawing pipe; a cylinder of which the upper portion is connected with the drawing pipe, the cylinder for receiving the water supplied from the drawing pipe; a rotating blade for generating the water-flow vortex in the cylinder; and a return pipe extended downward at a predetermined length from the upper side of the cylinder to the inner side of the cylinder along an axis of the vortex, the return pipe for returning the water in which dirt has been filtered into the tub.

A dirt collection part for collecting the dirt separated from the water is installed under the cylinder. The dirt collected in the dirt collection part is discharged by a discharging means. The discharging means comprises: a discharge pipe extended from the dirt collection part toward the outside; and a discharge valve for opening/closing the discharge pipe.

According to the preferred embodiment of the present invention, a sterilizing means is installed on a position of a path that the water circulates via the drawing pipe, the cylinder and the return pipe, the sterilizing means for sterilizing the water circulating through the path. The sterilizing means comprises: an ultraviolet lamp for generating ultraviolet rays; and a lamp casing for accommodating the ultraviolet lamp, the lamp casing of which a part contacting with the water is made of a material transmitting the ultraviolet rays.

According to the present invention, a washing machine having a filtering device is provided which can filter the dirt in washing water effectively, and need not be cleaned frequently. Furthermore, a sanitary washing operation can be performed by the sterilizing device.

BRIEF DESCRIPTION OF DRAWINGS

The present invention will be better understood and its various objects and advantages will be more fully appreciated from the following description taken in conjunction with the accompanying drawings, in which.

BEST MODE FOR CARRYING OUT THE INVENTION

Hereinafter, the present invention will be described in detail with reference to the accompanying drawings.

Figure 1:
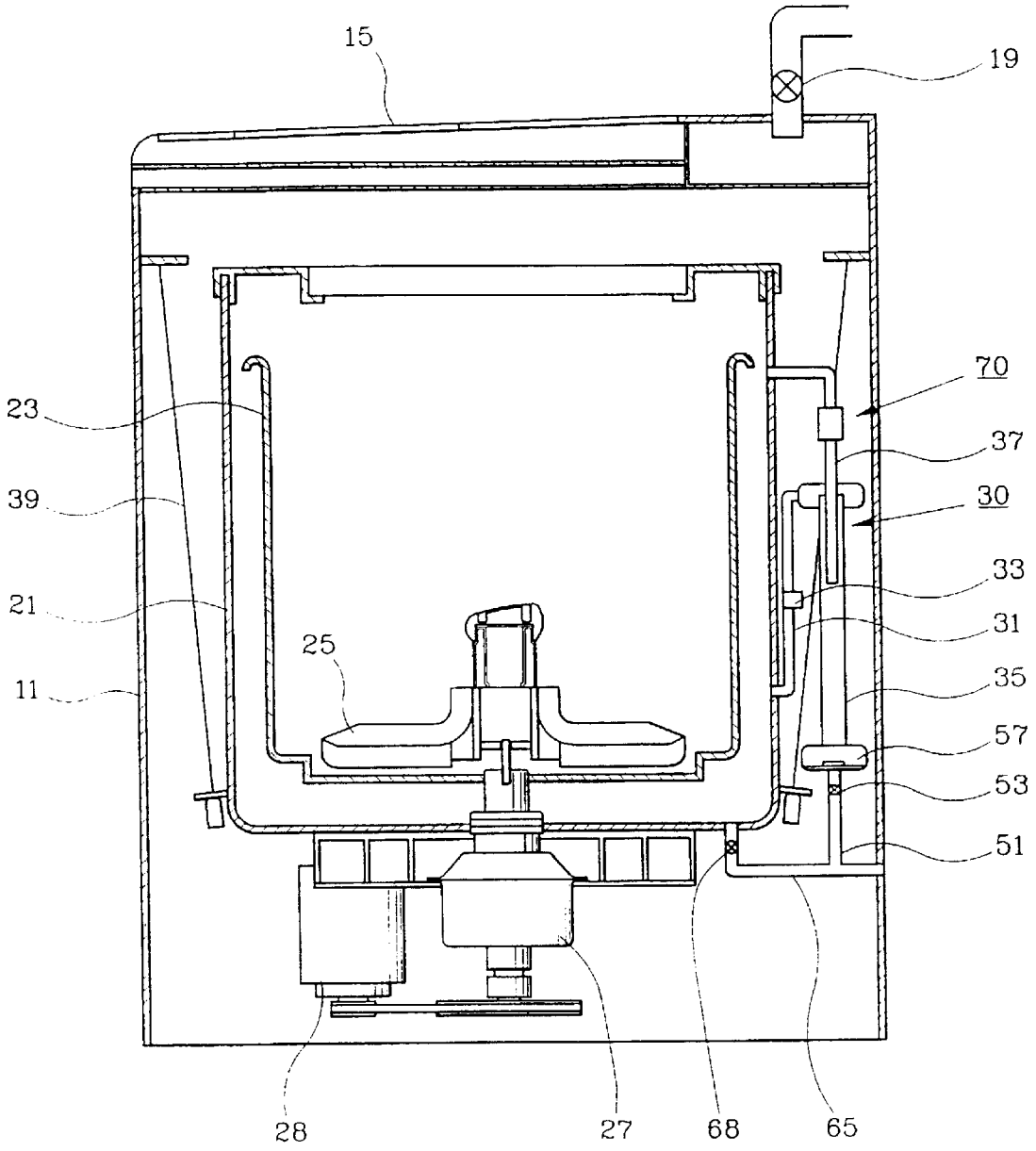
FIG. 1 is a side sectional view of a washing machine according to the present invention.

FIG. 1 is a side sectional view of a washing machine according to the present invention. The washing machine has an outer casing 11, a top cover 15 covering the upper side of the outer casing 11, an outer tub 21 suspended by suspensions 39 in the outer casing 11, a washing tub 23 rotatably installed in the outer tub 21, a pulsator 25 installed on the bottom of the washing tub 23, a driving motor 28 for driving the pulsator 25, a gear assembly 27 for transmitting the driving force of the driving motor 28 to the pulsator 25 and/or the washing tub 23, and a water supply valve 19 for supplying water into the washing tub 23 and the outer tub 21.

During the washing operation, the driving motor 28 rotates the pulsator 25, and by the water-flow vortex generated in such a situation, the laundry in the washing tub 23 is washed. During the dehydrating operation, the pulsator 25 and the washing tub 23 are rotated together at a high speed, and the laundry is dehydrated by the centrifugal force generated in that situation.

A drain pipe 65 is installed on the lower side of the outer tub 21, and a drain valve 68 is installed on the drain pipe 65. When the dehydrating operation is completed, the drain valve 68 opens the drain pipe 65 so as to drain the water in the outer tub 21 and the washing tub 23 toward an outside.

Figure 2:
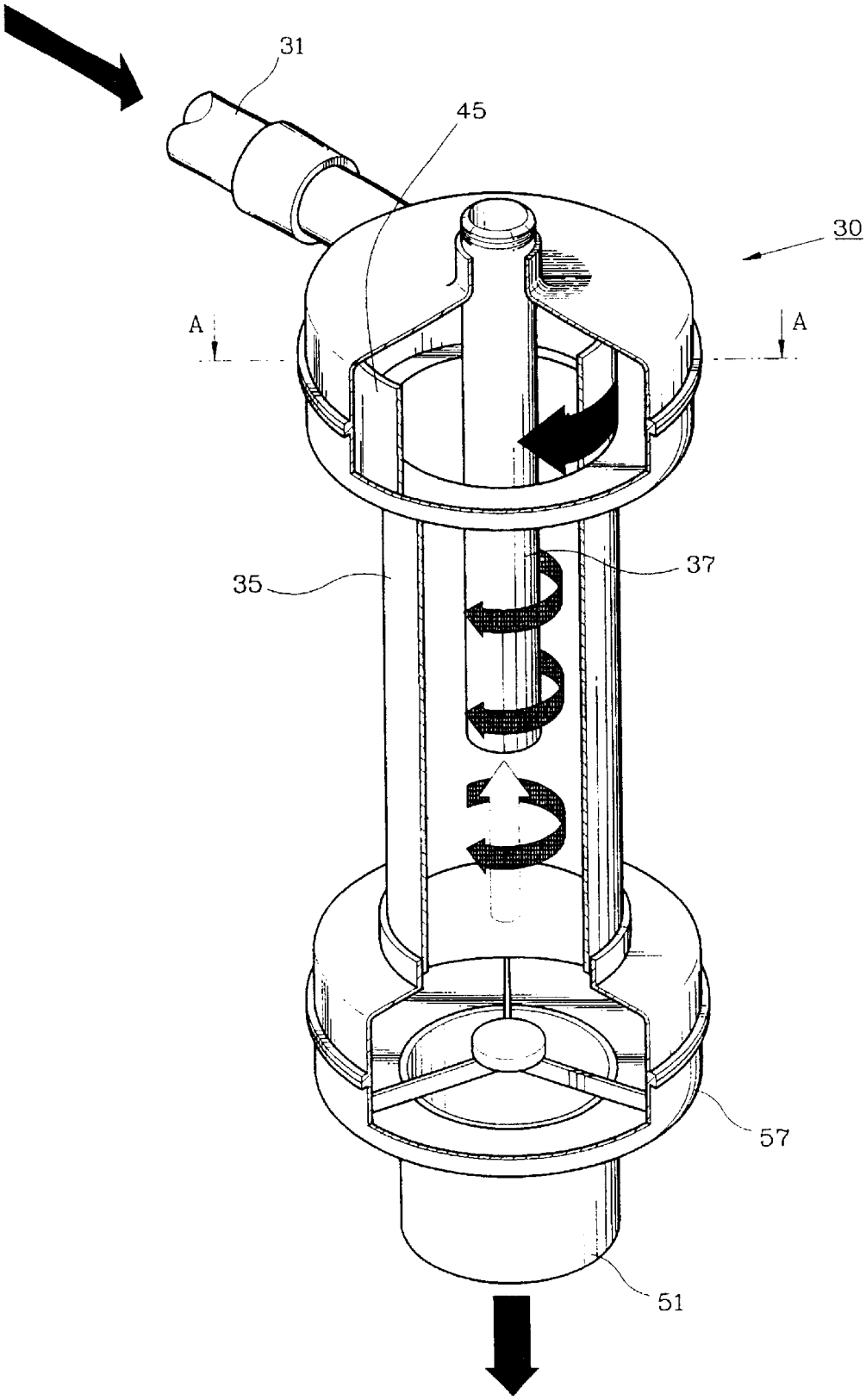
FIG. 2 is an enlarged perspective view of a filtering device shown in FIG. 1.

A filtering device 30 is installed beside the outer tub 21. The filtering device 30 is, as shown in FIGS. 1 and 2, comprised of a drawing pipe 31 connected to the outer tub 21, a drawing pump 33 installed in the middle of the drawing pipe 31, a cylinder 35 connected with the drawing pipe 31, a rotating blade 45 installed in the cylinder 35, and a return pipe 37 connected to the cylinder 35.

Figure 3:
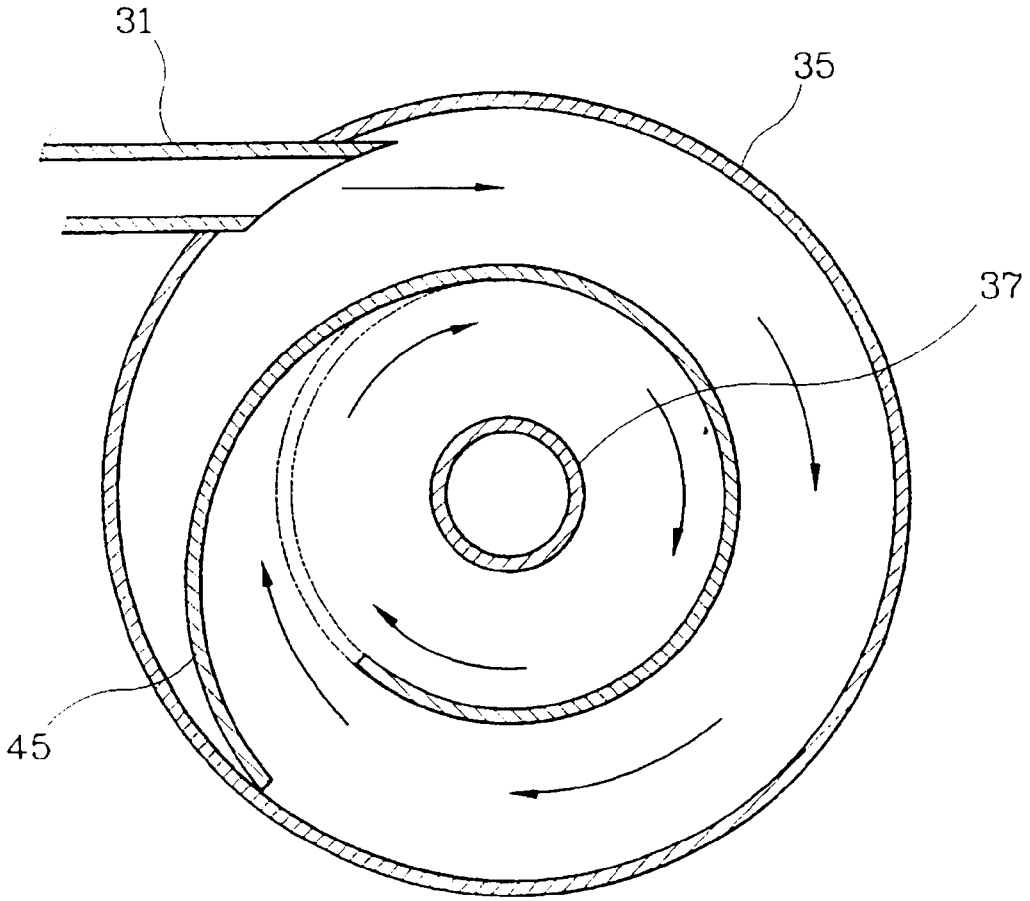
FIG. 3 is a sectional view of FIG. 2 taken along the line A—A.

The drawing pipe 31 is connected to the upper part of the cylinder 35 by a predetermined angle against the radial direction of the cylinder 35 as shown in FIG. 3. The drawing pump 33 draws the water in the outer tub 21 into the drawing pipe 31. The water drawn into the drawing pipe 31 is supplied into the cylinder 35.

The rotating blade 45 is curved spirally about the axis of the cylinder 35, and is rotated by a motor which is not shown in the figures. As the rotating blade 45 rotates, the water-flow vortex is generated in the cylinder 35.

The return pipe 37 is extended from the upper side of the cylinder 35 to the middle position of the cylinder 35 along the rotational axis of the water-flow vortex. The upper end of the return pipe 37 is connected to the outer tub 21. The water in the cylinder 35 is returned into the outer tub 21 through the return pipe 37.

A dirt collection part 57 for collecting the dirt separated from the washing water is formed under the cylinder 35. A discharge pipe 51 for discharging dirts collected in the dirt collection part 57 toward the outside is installed under the dirt collection part 57. The lower end of the discharge pipe 51 is connected to the drain pipe 65.

Meanwhile, the washing machine has a device 70 for sterilizing the washing water. The sterilizing device 70 is installed on a position of a path that the washing water is circulating via the drawing pipe 31, the cylinder 35 and the return pipe 37, and preferably, is installed on a middle area of the return pipe 37 as shown in FIG. 1.

Figure 4:
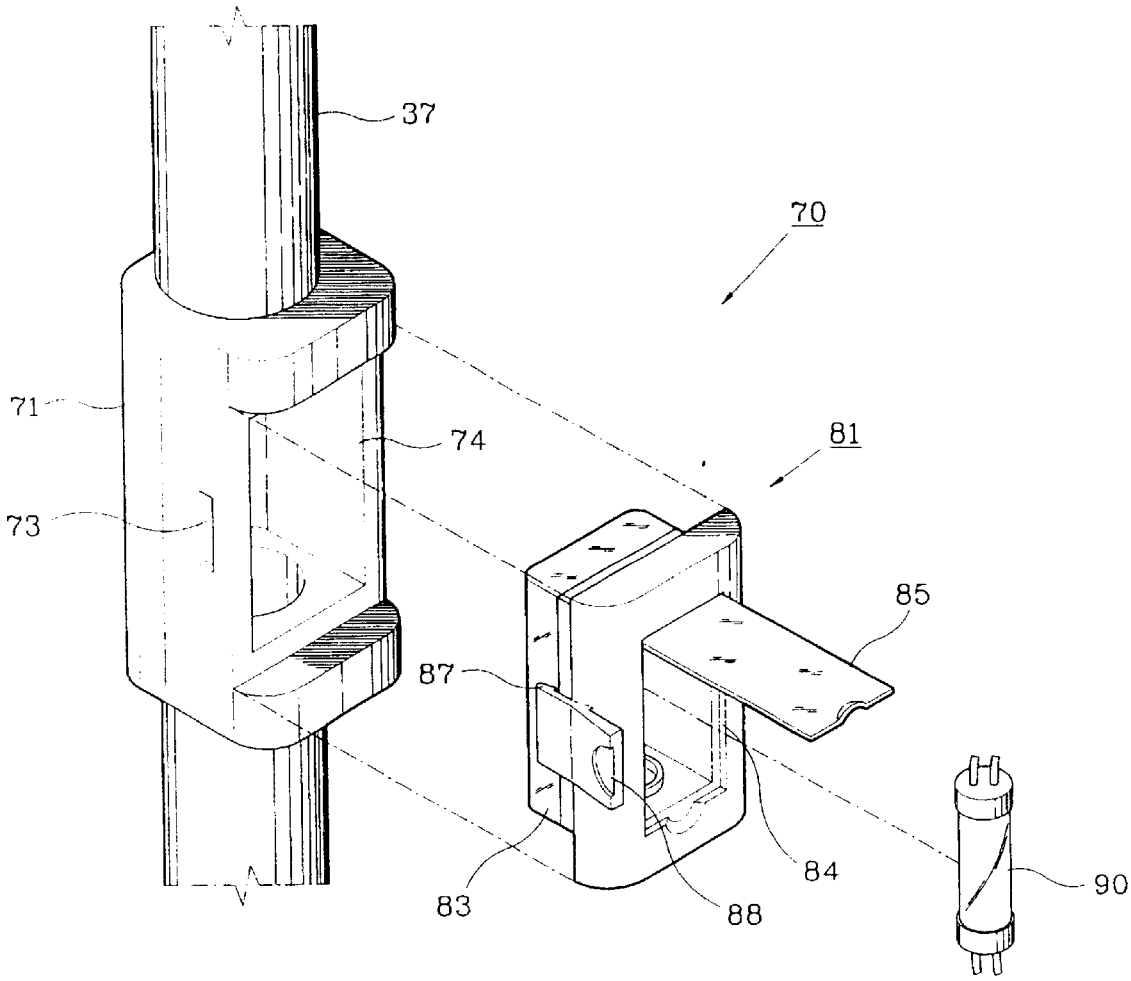
FIG. 4 is a perspective view of a sterilizing device shown in FIG. 1.
Figure 5:
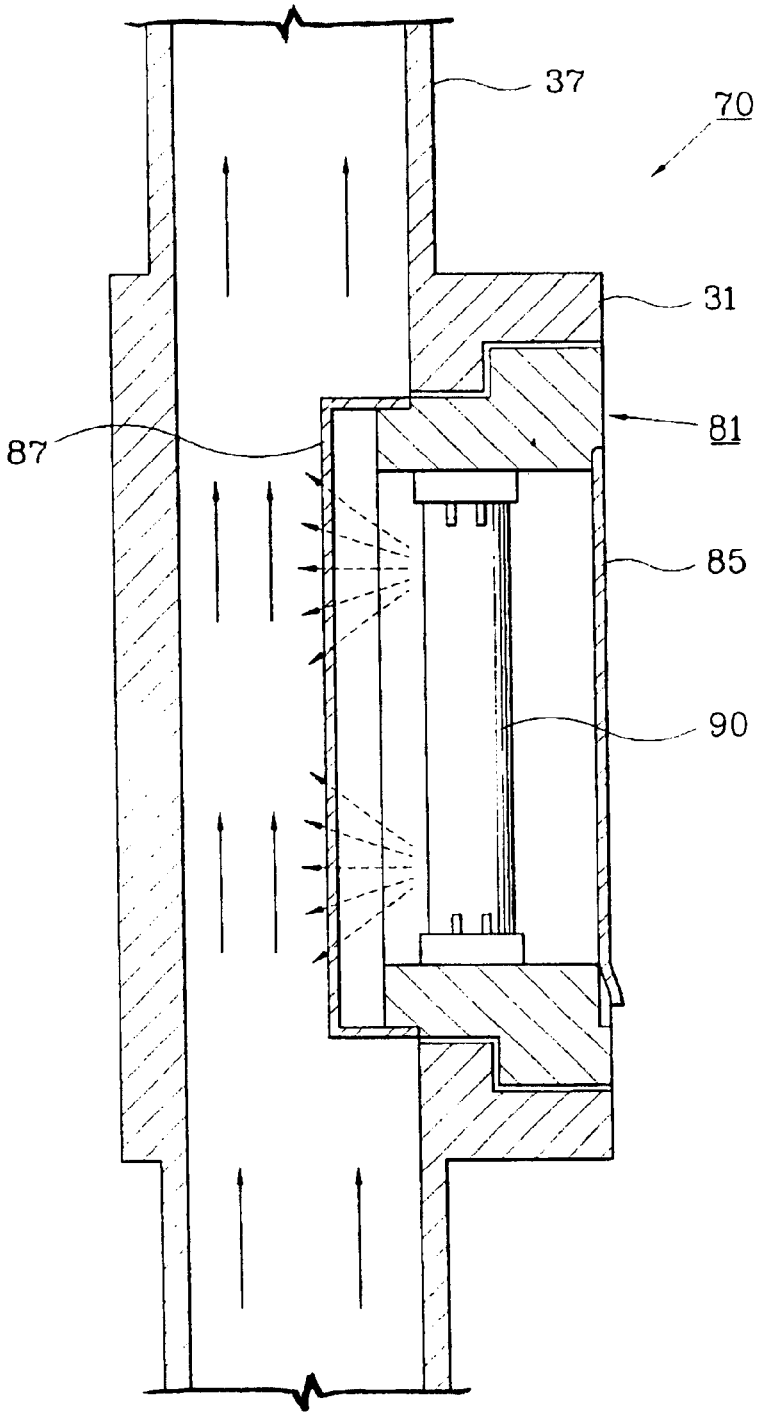
FIG. 5 is an enlarged side sectional view of the assembled state of FIG. 4.
Figure 6:
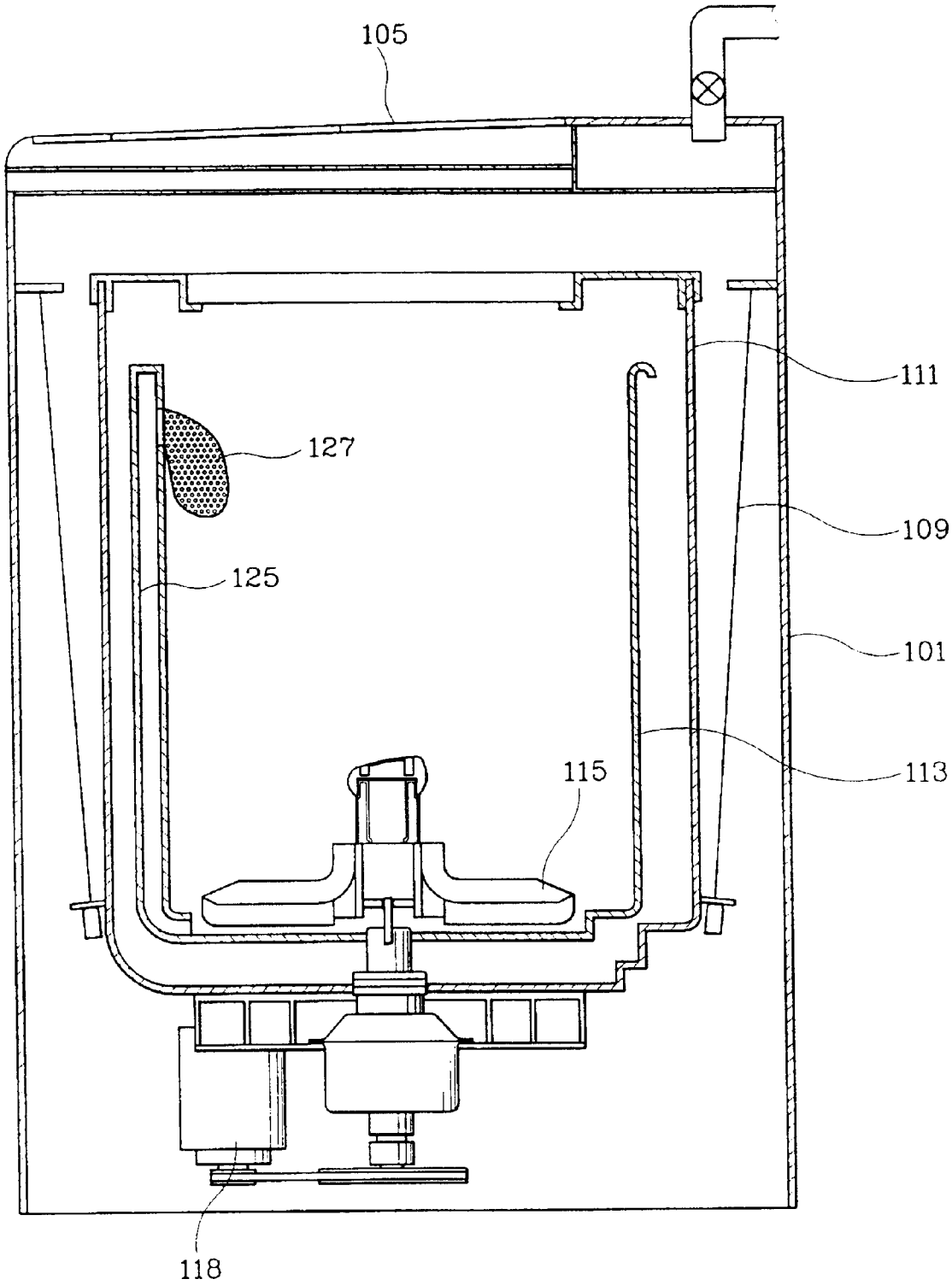
FIG . 6 (PRIOR ART)
FIG. 6 is a side sectional view of a conventional washing machine.

As shown in FIGS. 4 and 5, the sterilizing device 70 is comprised of an ultraviolet lamp 90 for generating ultraviolet rays, and a lamp casing 81 for accommodating the ultraviolet lamp 90. Power supply wires for supplying the ultraviolet lamp 90 with an electrical power are connected to the lamp casing 81.

An accommodation part 71 for accommodating the lamp casing 81 is provided on the return pipe 37. The accommodation part 71 has an assembly opening 74 with which the lamp casing 81 is assembled, and a fixing recess 73 for fixing the lamp casing 81.

The lamp casing 81 has an assembly section 83 assembled with the assembly opening 74 of the accommodation part 71, and a fixing lever 87. When the assembly section 83 is inserted into the assembly opening 74, the fixing lever 87 is assembled with the fixing recess 73 of the accommodation part 71, and therefore, the assembly section 83 is fixed while being inserted into the assembly opening 74. A knob depression 88 is formed on the outer side of the fixing lever 87. A user pushes the knob depression 88 to disassemble the fixing lever 87 from the fixing recess 73, and thereby the lamp casing 81 is disassembled from the accommodation part 71.

The assembly section 83 is in contact with the water flowing in the return pipe 37 while it is inserted into the assembly opening 74. The assembly section 83 is made of a material transmitting the ultraviolet rays so that the ultraviolet rays are projected on the water.

An opening 84 is formed on the outer side of the lamp casing 81 so that the ultraviolet lamp 90 can be installed on, and removed from, the lamp casing 81 therethrough, and a cover 85 is installed on the opening 84. The cover 85 is preferably made of a transparent material. The user can inspect the ultraviolet lamp 90 through the transparent cover 85 whether it is operating normally or not.

Hereinbelow, the operation of the washing machine according to the present invention will be described.

While the washing machine is performing the washing operation, the water in the outer tub 21 is drawn by the drawing pump 33, and the rotating blade 45 is rotated by the motor (not shown). Accordingly, the water is supplied from the drawing pipe 31 into the cylinder 35 continuously, and the water-flow vortex is generated in the cylinder 35 by the rotating blade 45 as shown in FIGS. 2 and 3 with arrows. Since the drawing pipe 31 is tilted against the radial direction of the cylinder 35 as shown in FIG. 3, the water-flow vortex is generated more effectively in the cylinder 35.

The water in the cylinder 35 receives a centrifugal force by the water-flow vortex. Thus, the weighty dirt contained in the water is distributed into the outer part of the vortex, and only the water without the dirt exists in the central part of the vortex. As the water is continuously supplied from the drawing pipe 31, the water in the lower portion of the cylinder 35 is supplied into the return pipe 37 by the hydraulic pressure of the water supplied from the drawing pipe 31, and the water and the dirt in the cylinder 35 are moved down gradually. Since the return pipe 37 is positioned on the axis of the water-flow vortex, only the water without the dirt is supplied into the return pipe 37, and the dirt is collected in the dirt collection part 37. The water supplied into the return pipe 37 is returned into the outer tub 21. Therefore, the water in which dirt has been filtered is re-supplied into the outer tub 21.

When a large amount of dirt is collected, the discharge valve 53 opens the discharge pipe 51 to discharge the dirt in the dirt collection part 57 toward the outside through the discharge pipe 51.

Meanwhile, the water returned through the return pipe 37 is sterilized by the sterilizing device 70. Therefore, a sanitary washing is performed. The user can inspect the ultraviolet lamp 90 through the transparent cover 85. And, since the lamp casing 81 can be detached, the ultraviolet lamp 90 can be exchanged with a new one easily when a breakdown occurs.

As described above, according to the present invention, a washing machine having a filtering device 30 is provided which can filter the dirt in washing water effectively, and need not be cleaned frequently. Furthermore, a sanitary washing operation can be performed by the sterilizing device 70.

Although the present invention has been described and illustrated in detail, it is clearly understood that the same is by way of illustration and example only and is not to be taken by way of limitation, wherein the spirit and scope of the present invention is limited only by the terms of the appended claims.

What is claimed is:

1. A washing machine comprising:

a tub for laundry and water;

a drawing pipe connected to the tub;

a drawing pump associated with the drawing pipe for drawing the water in the tub into the drawing pipe;

a cylinder for receiving water supplied from the drawing pipe and having an upper portion connected to the drawing pipe;

a rotating blade for generating a water-flow vortex in the cylinder; and a return pipe, extending downwardly a predetermined distance from the upper side of the cylinder to an inner side of the cylinder along an axis of the vortex, for returning water from which dirt has been filtered into the tub.

2. The washing machine as claimed in claim 1, further comprising a dirt collection part, installed under the cylinder, for collecting the dirt separated from the water.

3. The washing machine as claimed in claim 2, further comprising discharging means for discharging the dirt collected in the dirt collection part.

4. The washing machine as claimed in claim 3, wherein the discharging means comprises:

a discharge pipe extending from the dirt collection part toward the outside; and a discharge valve for opening and closing the discharge pipe.

5. The washing machine as claimed in claim 1, wherein the drawing pipe is connected with the cylinder at a predetermined angle with respect to a radial direction of the cylinder.

6. The washing machine as claimed in claim 1, further comprising a sterilizing means, installed at a position along a water circulation path including the drawing pipe, the cylinder and the return pipe, for sterilizing the water circulating through the path.

7. The washing machine as claimed in claim 6, wherein the sterilizing means is installed at a position along the return pipe.

8. The washing machine as claimed in claim 6, wherein the sterilizing means comprises:

an ultraviolet lamp for generating ultraviolet rays; and a lamp casing for accommodating the ultraviolet lamp, the lamp casing including a part contacting the water, said part being made of a material for transmitting the ultraviolet rays.

9. The washing machine as claimed in claim 8, wherein an opening is formed on an outer side of the lamp casing so that the ultraviolet lamp can be installed on, and removed from, the lamp casing therethrough; and a cover is installed on the opening.

10. The washing machine as claimed in claim 9, wherein the cover is made of a transparent material.

* * * * *